US006181290B1

(12) United States Patent
Zaitsev et al.

(10) Patent No.: US 6,181,290 B1
(45) Date of Patent: Jan. 30, 2001

(54) SCANNING ANTENNA WITH FERRITE CONTROL

(75) Inventors: Ernst Zaitsev; Anton Gonskov; Andrev Cherepanov, all of St. Petersburg (RU); George Yufit, Goleta, CA (US); Yakov Khodorkovsky, Brooklyn, NY (US)

(73) Assignee: Beltran, Inc., Brooklyn, NY (US)

( * ) Notice: Under 35 U.S.C. 154(b), the term of this patent shall be extended for 0 days.

(21) Appl. No.: 09/421,384

(22) Filed: Oct. 20, 1999

(51) Int. Cl.[7] ..... H01Q 11/06
(52) U.S. Cl. ..... 343/786; 343/754
(58) Field of Search ..... 343/786, 725, 343/778, 754, 777, 853; 333/24.1

(56) References Cited

U.S. PATENT DOCUMENTS

| | | | | |
|---|---|---|---|---|
| 4,150,382 | * | 4/1979 | King | 343/754 |
| 4,588,994 | | 5/1986 | Tang et al. | 343/754 |
| 4,785,304 | | 11/1988 | Stern et al. | 343/770 |
| 5,309,166 | * | 5/1994 | Collier et al. | 343/778 |
| 6,008,775 | * | 12/1999 | Bobowicz et al. | 343/853 |

FOREIGN PATENT DOCUMENTS

| | | |
|---|---|---|
| 2000633 | 9/1993 | (RU) . |
| 1072154 | 2/1984 | (SU) . |
| 1223318 | 4/1986 | (SU) . |
| 1327207A1 | 7/1987 | (SU) . |
| 1370690A1 | 1/1988 | (SU) . |
| 1596413A1 | 9/1990 | (SU) . |
| 1596416A1 | 9/1990 | (SU) . |
| 1637620A1 | 5/1993 | (SU) . |

OTHER PUBLICATIONS

Innovative Integrated Ferrite Phased Array Technologies (IEEE International Symposium Publication) (Boston, MA, 1996).

* cited by examiner

*Primary Examiner*—Tan Ho
*Assistant Examiner*—James Clinger
(74) *Attorney, Agent, or Firm*—Lawrence G. Fridman

(57) ABSTRACT

A scanning antenna with ferrite control comprising a waveguide consisting of top and bottom ferrite layers and an intermediate layer. An array of radiating dipoles situated at the upper surface of the top ferrite layer. A horn structure containing first and second horn elements extending longitudinally along both sides of the array of radiating dipoles. Each horn element has an engaging part, a spacing part, and an inner wall. The spacing parts extending along and spaced from the top ferrite layer forming respective gaps therebetween. Dielectric spacers are provided at both sides of the array of dipoles and placed within the respective gaps. Each horn element is formed with at least one groove extending inwardly from the respective spacing part and longitudinally along the axis of the waveguide. The longitudinal grooves and the dielectric spaces restrict excitement of the parasitic modes in the waveguide and reduce power losses in the antenna.

20 Claims, 7 Drawing Sheets

SCANNING ANTENNA WITH FERRITE CONTROL

BACKGROUND OF THE INVENTION

1. Field of the Invention

The invention relates to the field of electronically scanning antennas and in particular, to millimeter-wave antennas controlled by ferrite magnetizing.

2. Description of the Prior Art

Antennas with ferrite control of a beam based on a controlled lenses technology are known in the prior art. One of the examples of such antennas is disclosed by U.S. Pat. No. 4,588,994. This antenna having small radiating aperture dimensions, not exceeding five wavelengths (5λ), is not capable of providing a narrow beam. An array of several lenses contains unilluminated areas in the aperture causing high order diffraction of maximal radiation. The lenses have a complicated and large control circuit as well as large longitudinal dimensions.

The other approach for the electrical scanning on the basis of a ferrite control technology is disclosed by U.S. Pat. No. 4,785,304. This patent provides an array of waveguide-slot antennas of traveling waves, with each waveguide formed as a solid ferrite rod having a rectangular cross-section containing a metallized surface. Radiating slots are disposed at the top region of the rod. When the ferrite is magnetized in the longitudinal direction, scanning is carried out by means of variations of the phase velocity of the operating waveguide mode. The dimensions and weight of this antenna are substantially reduced compared to those of other prior art antennas. Nevertheless, this antenna contains multiple drawbacks. In this respect, when the beam is normal to the antenna, an in-phase adding of reflections (so called <<normality effect>>) occurs causing the gain drop and pattern diagram distortion. If the ferrite is demagnetized, then while the beam is at the center of the scanning sector, another mode of the same direction is intensively excited. This diminishes gain and produces greater side lobe levels. Furthermore, in the antenna of this patent, since the magnetic circuit is not closed, additional phase distortions appear. This occurs due to non-homogeneous magnetization of the ferrite rod along its length. The shortened circuit formed by the metallization around the rod, among other reasons, substantially increases the time of beam switching and the control power consumption.

A similar antenna is disclosed by the Russian Patent No. 2,000,633, in which each waveguide is formed by two ferrite layers. A thin dielectric element made of a material having substantial dielectric permeability is placed between the ferrite layers. Since only a bottom surface is metallized, the waveguide of this antenna is of an open type. Radiating elements are in the form of microstrip dipoles situated at the top surface. The waveguide operates at only a single low order mode also representing an operating mode. In this antenna, the high order modes have significantly different phase velocities and therefore are poorly excited. Due to the waveguide non-reciprocity of the waveguide, the <<normality effect>> can be avoided in the entire scanning sector including the beam area situated along the normal to the antenna. Since the magnetic circuit is of the closed type, resembling a toroid, the power consumption is decreased. The antenna has a low profile design and low weight characteristics.

An important drawback of the above discussed prior art antenna is that all waveguides have to be substantially identical and thus, should be equally magnetized during the scanning. This leads to the excessive tolerance requirements substantially raising the price of the antenna. Furthermore, it is quite difficult to provide homogeneous magnetizing of the ferrite layers even under perfect conditions. This is because, the magnetizing is maximal in the central region, and diminishes in the area of outer rows of dipoles. Consequently, upon magnetizing of the ferrite layers, i.e. while the antenna beam deviates from an average position, the characteristics of this prior art antenna deteriorate.

Another prior art antenna is disclosed by IEEE International Symposium on Phase Array System and Technology Publication (Boston, Mass. 1996). This antenna is formed with three layer ferrite-dielectric structure and contains only one row of radiating dipoles providing a narrow beam in H-plane (containing the vectors of the magnetic field and passing along the axis of the waveguide). The directivity in the E-plane (containing the vectors of the electrical field and directed transversely the axis of the waveguide) is achieved by two additional metal elements directly disposed at the top surface of a top ferrite layer at both sides of an array of radiating dipoles. The inner-walls of these metal elements facing each other are positioned at an angle to a vertical plane and form diverging walls resembling a horn structure.

In this antenna, the metal elements forming the horn structure are directly connected to the top ferrite layer significantly affecting the properties of the ferrite dielectric waveguide. This generates parasitic modes including those propagating transversely with respect to the waveguide axis. Upon reaching outer edges of the three-layer waveguide, such parasitic modes radiate a part of the power energy from the side surfaces of the antenna which results in substantial deterioration of the efficiency of the antenna. This prior art antenna is typically unsuitable for independent usage and is intended to be utilized as a line scanning irradiator for a parabolic cylindrical antenna.

SUMMARY OF THE INVENTION

One object of the invention is to provide a simple and inexpensive ferrite control antenna having high performance characteristics while operating in the millimeter-wave range. The antenna of the invention comprises a three-layer ferrite-dielectric waveguide consisting of two ferrite layers and an intermediate layer situated therebetween which includes an intermediate strip of dielectric material having high dielectric permittivity ($\epsilon \approx 40$). The width of the intermediate dielectric strip is about a half of wavelength $\lambda/2$ whereas the thickness of each ferrite layer is essentially less than wavelength $\lambda$. An array of radiating dipoles is disposed at an upper surface of the top ferrite layer at a distance of about $\lambda/2$ from each other.

In order to increase efficiency of the radiation of the antenna to the upper hemisphere, the lower surface of the bottom ferrite layer is substantially covered by a screen of solid metallization.

Beam control is carried out by to phase velocity variations of the mode which travels along the waveguide and excites the currents in the array of dipoles. The phase velocity variation occurs upon magnetizing of the ferrite layers by the current flowing through the wires of control winding. These wires extend between the ferrite layers on both sides of the intermediate dielectric strip along the entire length of the antenna and coiled about the bottom ferrite layer. As a result, the top and bottom ferrite layers are magnetized in the opposite directions in the plane perpendicular to the waveguide axis. Intermediate ferrite strips providing closure of the controlling magnetic flux are placed between the top and bottom ferrite layers on both sides of the control wires. The thickness of both intermediate ferrite strips is equal to the thickness of the intermediate dielectric rod, thus, forming a toroid-type magnetic circuit. This allows switching of the beam from one position to another during less than 5–10 microseconds with a low power consumption (less than 1 mJ.) At a static beam position the control circuit consumes power of about 2–5 W.

The antenna beam scans in the plane containing the vectors of the magnetic field which passes along through the waveguide axis (H-plane). The beam width in this plane depends on the number of dipoles and the length of the antenna. The optimal number of dipoles ranges from 15 to 60, whereas the corresponding beam width is within the range between 8° and 2°. The scanning sector depends on the operating wavelength and is about 40° for an 8-mm band antenna and about 20° for a 4-mm band antenna. The scanning sectors can be doubled if both ends of the three-layer waveguide are used alternately as input or output regions of the antenna. A connection between the three-layer waveguide and the standard rectangular waveguide is carried out by a two-stage dielectric transformer.

The horn structure consists of substantially symmetrical first and second horn elements extending longitudinally along both sides of the array of radiating dipoles. Each horn element has an engaging part, a spacing part and an inner-wall. The engagement parts of the first and second horn elements envelope side surfaces of the waveguide and connected to the metal frame. The spacing parts extend along and spaced from the top ferrite layer forming respective gaps therebetween. Dielectric spacers are provided within the respective gaps at both sides of the array of dipoles. The inner wall of each horn element consists of an upper and lower inner wall portion. The lower innerwall portions are substantially parallel to the plane normal to the top layer of the waveguide, whereas the upper inner wall portions diverge with respect to this plane so as to narrow the areas of the beam to the range between 15° and 45°. The area of the beam in the E-plane varies between 45° to 15° depending on the formation of the diverging portion of the horn arrangement.

In the invention, the horn arrangement not only determines the beam in the E-plane, but also significantly affects the radiating parameters of dipoles and their impedance properties. Moreover, the existence of the horn arrangement changes the properties of the three-layer waveguide, so that propagation of accelerated modes becomes possible. Each horn element is formed with at least one longitudinal groove extending inwardly from the respective spacing part and transversely to the top ferrite layer. The longitudinal grooves and the dielectric spacers positioned within the gaps between the waveguide and the horn structure are adapted to restrict excitement of the parasitic modes in the waveguide and to reduce the power losses in the antenna.

The inclined screen, provided to reduce parasitic radiation from the area of joining the standard waveguide with the three-layer waveguide at the antenna's input, is an additional means for decreasing the side lobe level.

BRIEF DESCRIPTION OF THE DRAWINGS

Other advantages and features of the invention are described with reference to exemplary embodiments which are intended to explain and not to limit the invention and are illustrated in the drawings in which.

DETAILED DESCRIPTION OF THE PREFERRED EMBODIMENT

Figure 1:
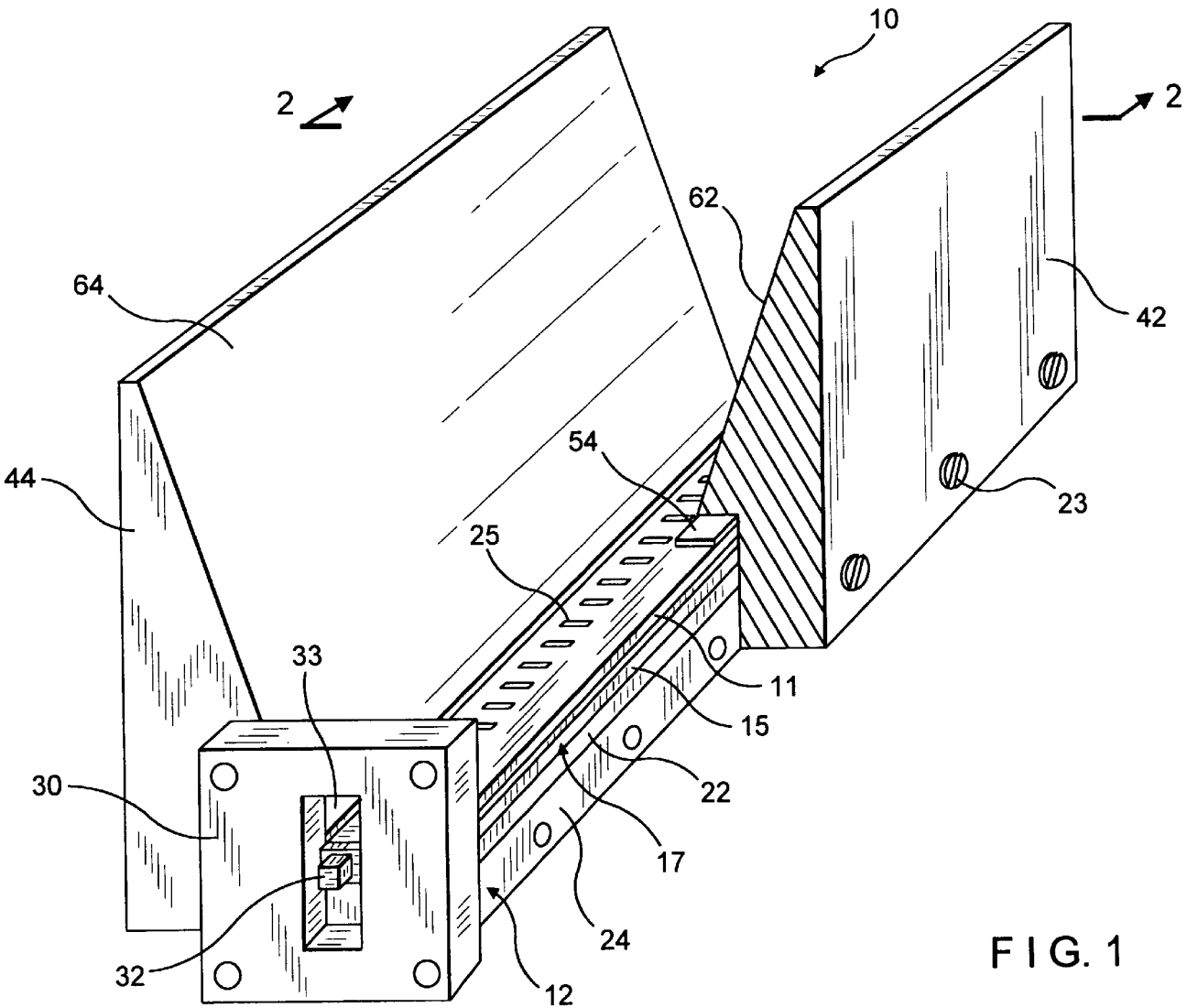
FIG. 1 is a perspective, semi-sectional view of the antenna of the invention exposing the three-layer ferrite-dielectric waveguide.

Referring now to FIGS. 1–11, wherein the scanning antenna 10 of the invention is illustrated including at least the following elements: a waveguide 17, a base 22, a frame 24, a horn structure 26 and an input flange 30 with a matching dielectric transformer 32.

Figure 2:
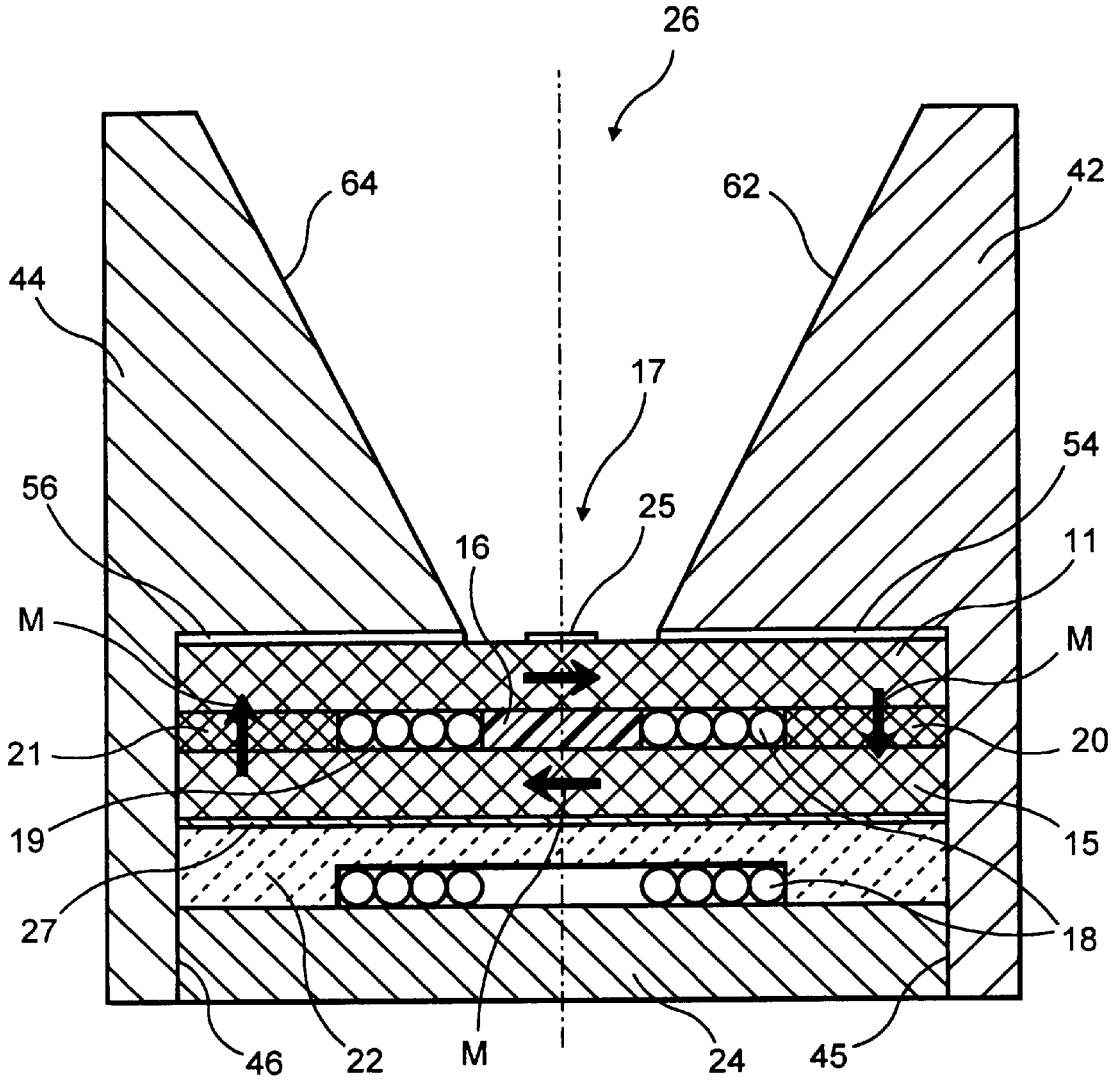
FIG. 2 is a cross-section of the antenna along section line 2—2 of FIG. 1.
Figure 3:
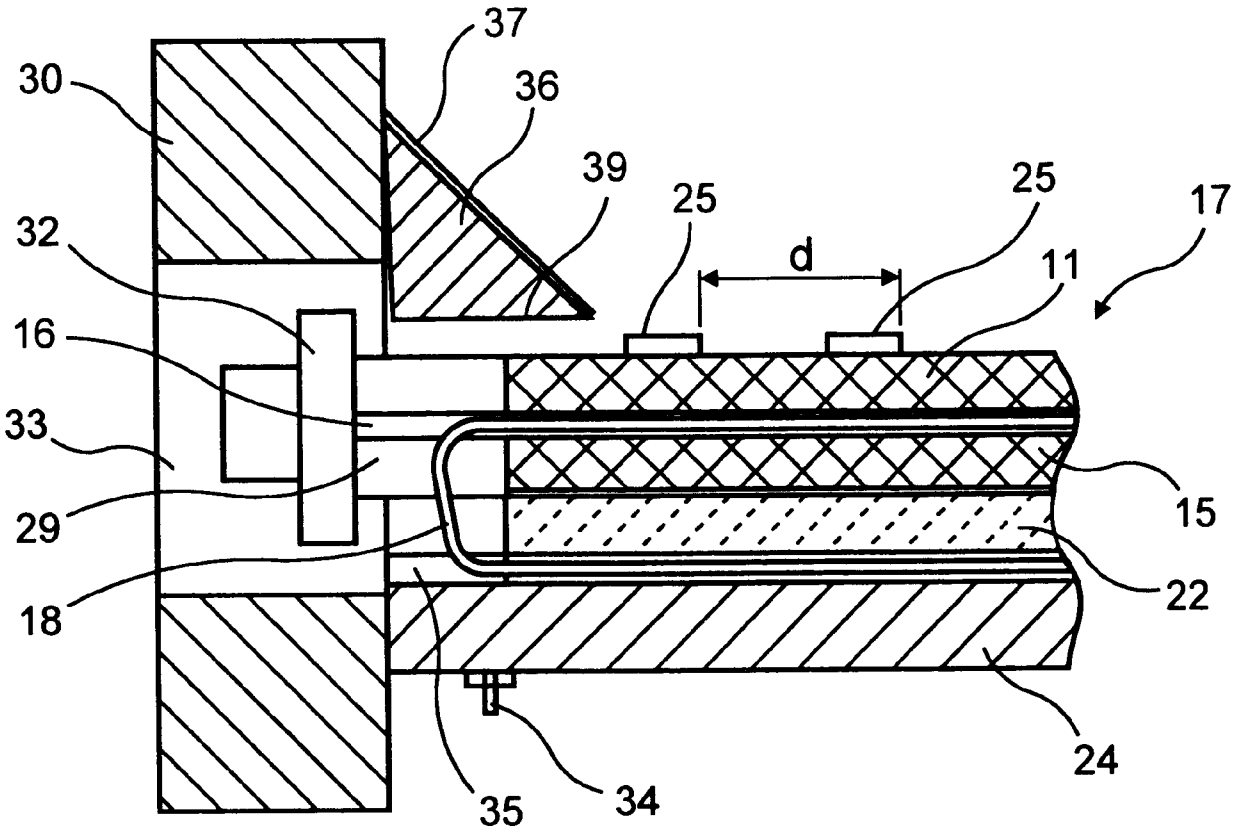
FIG. 3 is a partial longitudinal sectional view of the antenna in the vicinity of the input region.
Figure 5:
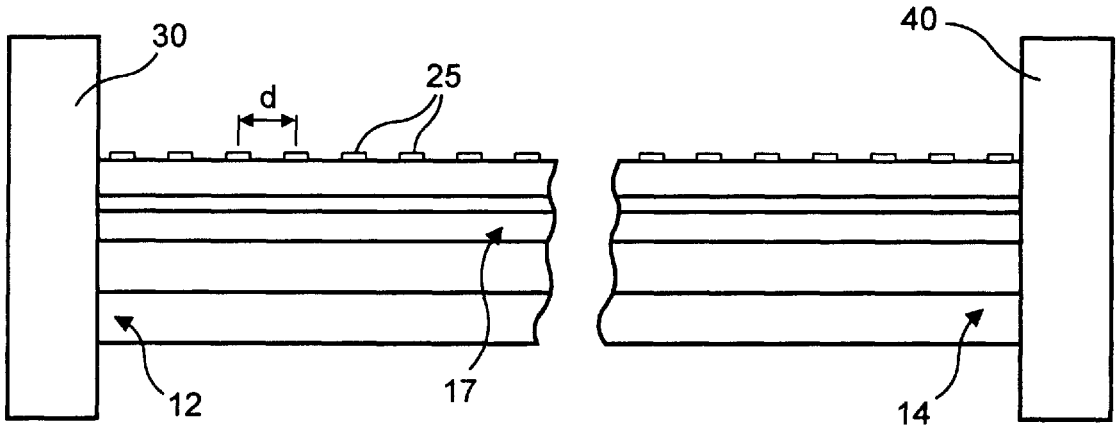
FIG. 5 is a schematic view of the antenna having two input/output regions.
Figure 6:
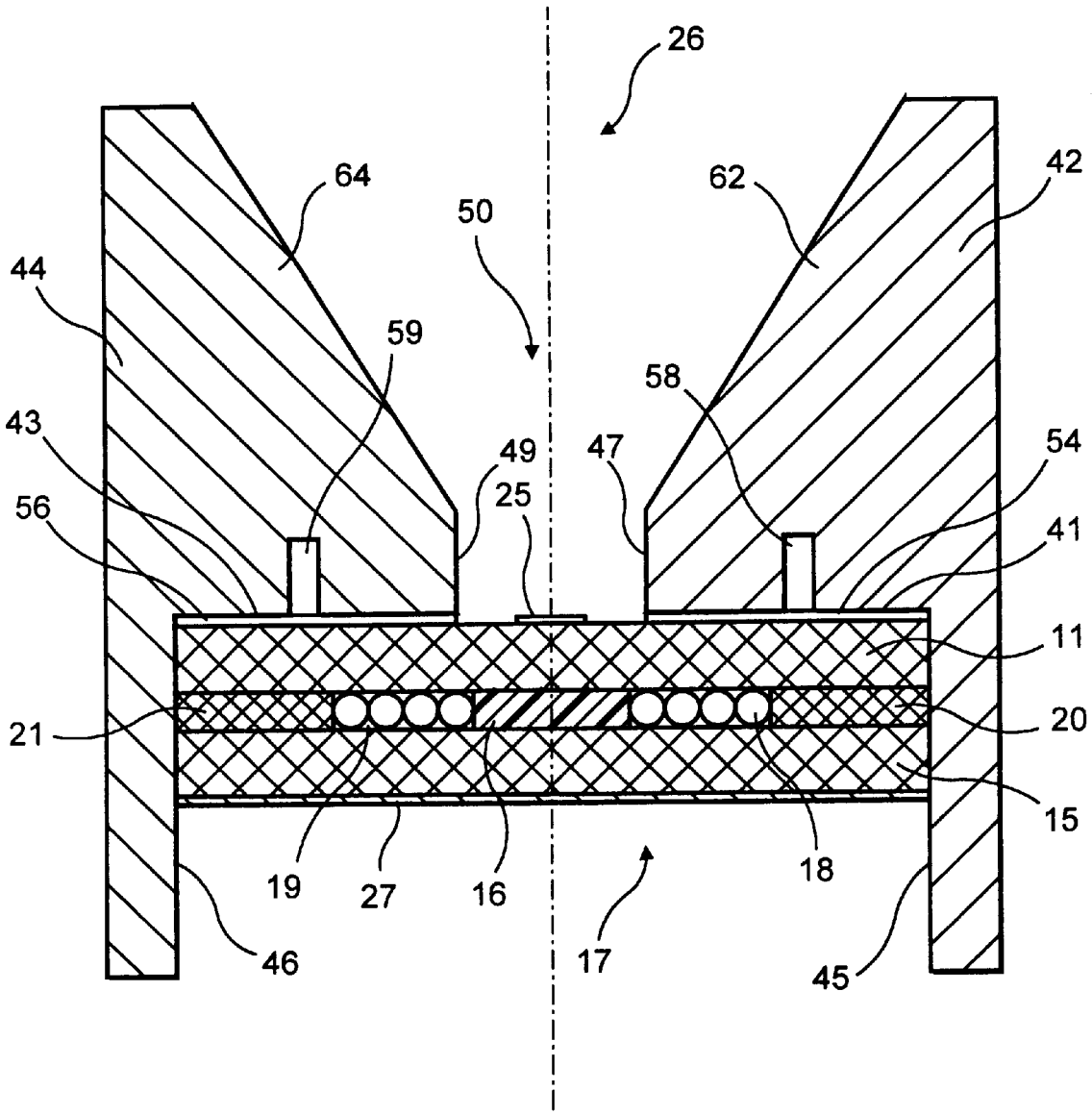
FIG. 6 is a cross-sectional view of a further embodiment of antenna without a base and a frame.

A cross-section of a three-layer ferrite-dielectric waveguide 17 having an electrically controlled moderation factor is best illustrated in FIGS. 2,3 and 6. The waveguide 17 extending between a first end 12 and a second end 14 (see FIG. 5) contains a top layer 11 and a bottom layer 15 both formed from a ferrite material. An intermediate layer 19 (see FIG. 2) which is disposed between the layers 11 and 15, represents a composite structure with a centrally situated intermediate dielectric strip 16. The strip 16 is made of a dielectric material with high value of relative dielectric permittivity ($\epsilon$=35–40). In one embodiment of the invention the strip 16 is made from a ceramic material and formed having a substantially rectangular cross-section. However, other configurations and use of various dielectric materials in fabrication of the strip 16 is within the scope of the invention.

Wires of control winding 18(see FIG. 2) are placed along the dielectric strip 16 at both sides thereof. The outer elements of the intermediate layer are ferrite strips 20, 21 having the thickness which is substantially equal to the thickness of dielectric strip 16. The width of the dielectric strip 16 is generally about a half of a wave length ($\lambda/2$), whereas the combined thickness of all three layers of the waveguide 17 is substantially less than wave length ($\lambda$).

A multiplicity of radiating dipoles 25 is disposed in a row at an upper surface of the top ferrite layer 11, along the intermediate dielectric strip 16. The dipoles 25 are oriented generally transverse to the waveguide axis A—A, with the distance between dipoles of about half of a wave length ($\lambda/2$). To avoid radiation in the lower hemisphere, the lower surface of the bottom layer 15 is substantially covered by a screen or a layer of solid metallization 27 (see FIG. 2, for example).

In one embodiment of the invention, ferrite and dielectric elements of the waveguide are fabricated by high precision grinding. The metal screen 27 on the bottom ferrite layer 15 is formed by spraying of aluminum on the initially polished surface. The dipoles 25 are sprayed through a template on the upper surface of the top ferrite layer 11. It should be noted, however, that other methods of the waveguide fabrication are within the scope of the invention.

Since all layers of the waveguide are substantially thin (less than 1 mm), the strength of the structure is enhanced by the dielectric base 22 which is typically made of a ceramic material. The elements of the three-layer waveguide 17 are glued or by any other conventional means attached to the base 22. The base 22, as well as other elements of the invention are supported by the frame 24, which can be made from metal.

In the preferred embodiment, the thickness of the base 22 is about 2–3 mm. An area of the base facing the frame 24 contains either single or multiple longitudinal grooves adapted to receive the wires 18 of control winding. The wires 18 are disposed within the groove and coiled around the bottom ferrite layer 15 and the dielectric base 22 (see FIG. 2).

As best illustrated in FIGS. 1, 2 and 6 the input flange 30, the elements forming horn structure 26, the waveguide 17, etc. are supported by the frame 24. The elements of the horn structure can be attached to the frame 24 by any conventional means including fasteners 23 (see FIG. 1).

FIG. 3 illustrates the longitudinal section of the antenna in the vicinity of the first input region. The first input flange 30 is provided at the first end 12 of the waveguide and adapted to facilitate connection of the antenna to a conventional waveguide which can have a substantially rectangular cross-section (not shown). An input window 33 is centrally formed within the flange 30. To transform the wave of the standard waveguide into the operating mode of the three-layer waveguide 17, a two-stage matching transformer 32 is provided within the input flange window 33. In the preferred embodiment, the transformer 32 is made of a dielectric material with dielectric permittivity being about 5–7. At the first input region (see FIG. 3), the intermediate dielectric strip 16 extends outwardly from the rest of the waveguide elements forming a tip 29. The transformer 32 is glued or by any other conventional means connected to the tip 29.

As illustrated in FIG. 3, the elements of the antenna including the dielectric base 22 are spaced from the first input flange 30 forming a gap 35. The wires 18 of the control winding upon passing through the gap 35 and through the openings in the metal frame 24 (not shown) are connected to the outlets 34.

A complete conversion of the wave of the conventional rectangular waveguide into the operating mode of the three-layer waveguide 17 is a difficult task. The power dissipates through the window 33 of the input flange 30. Such dissipation only slightly affects the power characteristics of the antenna. However, the radiation resulted from the dissipation of power creates almost isotropic background of radiation and can raise the side lobe levels. Experiments have shown, that parasitic radiation from the flange window 33 can be effectively suppressed by the inclined screen 36 which is attached to the input flange 30 and contains a layer of absorbing material having a metallized outer surface 37. The lower surface 39 of the screen 36 is placed at a distance of 0.5–1.0 millimeters from the upper surface of the top ferrite layer 11. In this condition, the field of the operating mode of the three-layer waveguide 17 diminishes to an extent that the existence of the screen does not affect the operating mode.

Figure 4:
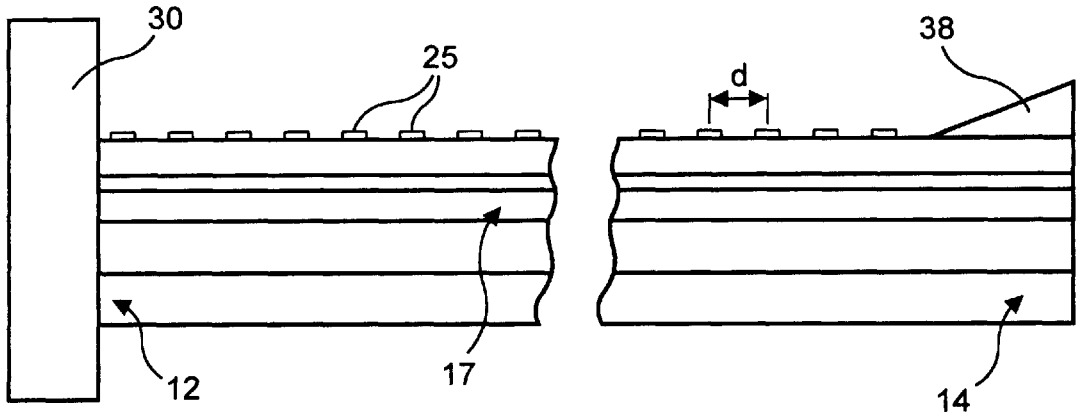
FIG. 4 is a schematic view of the antenna having one input/output region.

To diminish the reflection, the second end 14 of the waveguide 17 can be covered by a wedge-shaped member 38 made of an absorbing material (see FIG. 4).

As illustrated in the embodiment of FIG. 5, the second end 14 of the waveguide can be formed with a second input flange 40 having a dielectric matching transformer (not shown) similar to that of the first inlet flange 30, thus forming a second alternative input region.

As best illustrated in FIGS. 1, 2 and 6 the horn arrangement 26 of the invention consists of first 42 and second 44 horn elements symmetrically extending along the waveguide 17 at both sides of the dipoles 25. Each horn element is formed with an engaging part 45, 46 and spacing part 41, 43 positioned at an angle to each other. An inner region 50 of the horn arrangement 26 is formed by the innerwalls facing one another. In the embodiment of FIG. 6, each innerwall includes a lower innerwall portion 47, 49 and an upper innerwall portion 62, 64. The lower inner wall portions 49 and 47 are substantially parallel to each other and to the plane substantially perpendicular to the top ferrite layer 11 of the waveguide 17, whereas the upper innerwall portions diverge with respect to the same plane. In the assembled condition of the invention, gaps are formed between the spacing parts 41 and 43 and the upper surface of the top ferrite layer 11 which are adapted for receiving dielectric spacers 54 and 56. Engaging parts 45 and 46 of the horn elements are connected to the side surfaces of the waveguide 17, the dielectric base 22 and the metal frame 24.

The above discussed design of the inner region 50, wherein the lower innerwall portions are substantially parallel and the upper innerwall portions are diverging, provides uniform amplitude distribution. In this part of the horn structure, the distance between the substantially parallel innerwalls and the height of the innerwalls is about a half of a wavelength. Thus, only the lowest mode propagates in this area of the horn structure, with other modes being eliminated. As a result, the upper part of the inner region 50 is excited by only one mode.

As clearly illustrated in at least FIG. 6, a substantial portion of the ferrite-dielectric waveguide 17 is shielded or enveloped by a shield of metallic material. The lower portion of the bottom ferrite layer is covered by the layer of metallized material 27. The sides of the waveguide 17 are shielded by the engaging parts 45, 46 of the first and second horn elements, whereas the spacing portions 41 and 43 extend over a substantial portion of the upper surface of the top ferrite layer 11. This arrangement forms a closed type waveguide in which the horn arrangement 26 and the waveguide 17 are combined in a shielded uniform, structure. It should be noted that the array of dipoles 25 associated with the waveguide 17 is an exciting unit of the horn structure.

In the embodiment of FIGS. 1 and 2, the inner region of the horn arrangement is formed only by the diverging inner walls 62 and 64.

Figure 7:
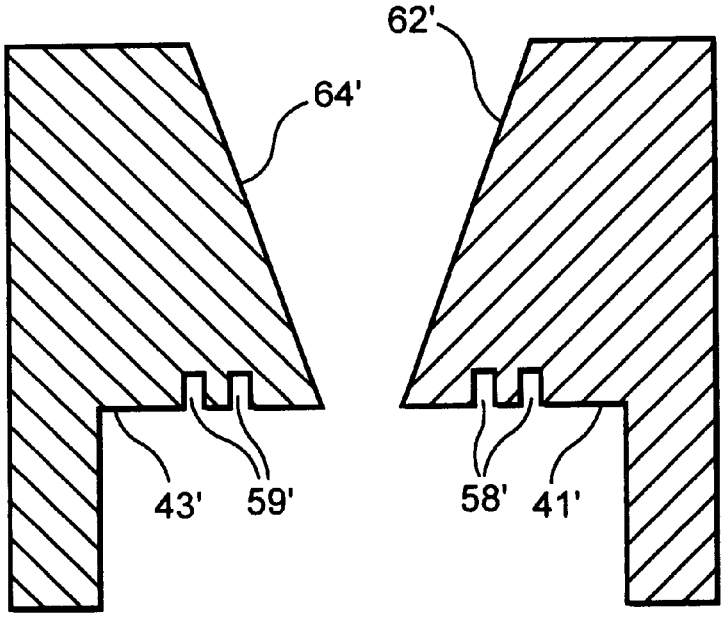
FIG. 7 is a view showing one embodiment of the horn elements.
Figure 8:
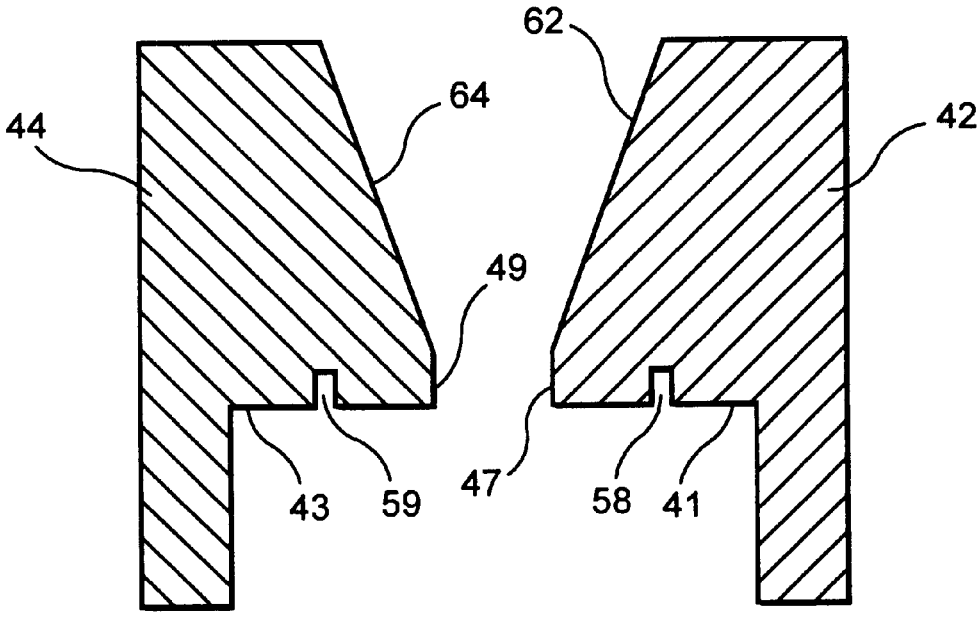
FIG. 8 is a view showing another embodiment of the horn elements.

As illustrated in FIGS. 6,7 and 8 the horn elements can be formed with longitudinal grooves extending inwardly from the respective spacing parts along the axis of the waveguide 17. For example, in the embodiment of FIG. 8, each spacing part 41, 43 is formed with a single longitudinal groove 58, 59. In the embodiment of FIG. 7, each engaging part 41', 43' is formed with a pair of grooves 58', 59'. The height of the gaps between the spacing parts 41, 43 and the upper surface of the top ferrite layer 11 is adjustable to accommodate the dielectric spacers 54 and 56 of various thickness. The gaps including the dielectric spacers and the grooves 58, 59 affect only the high order modes without disturbing the main operational mode. This enhances optimization of the characteristics of the antenna.

Figure 9:
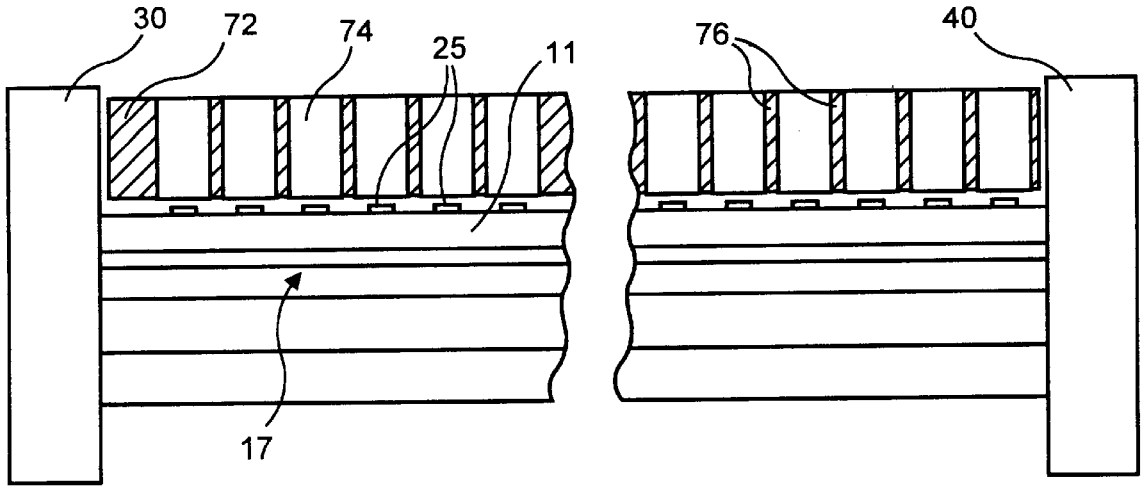
FIG. 9 is a schematic view showing an alternative design of the horn arrangement.
Figure 10:
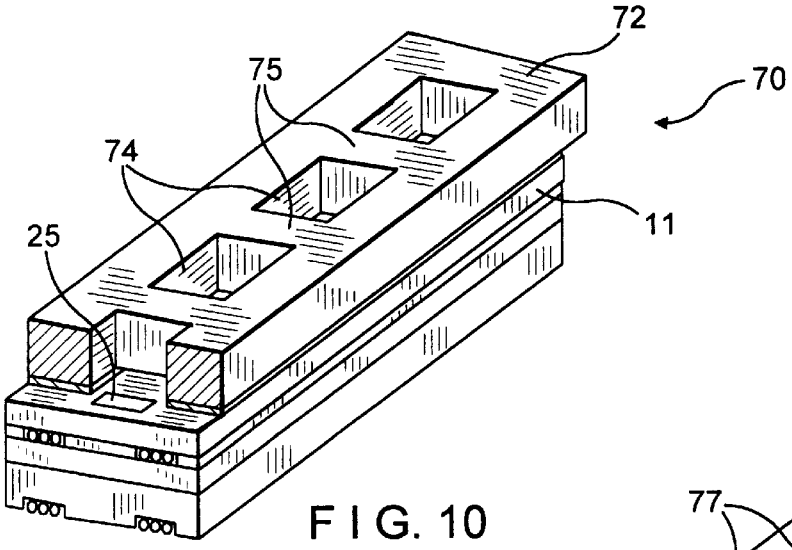
FIG. 10 is a partial, perspective view of another alternative embodiment of the horn arrangement.
Figure 11:
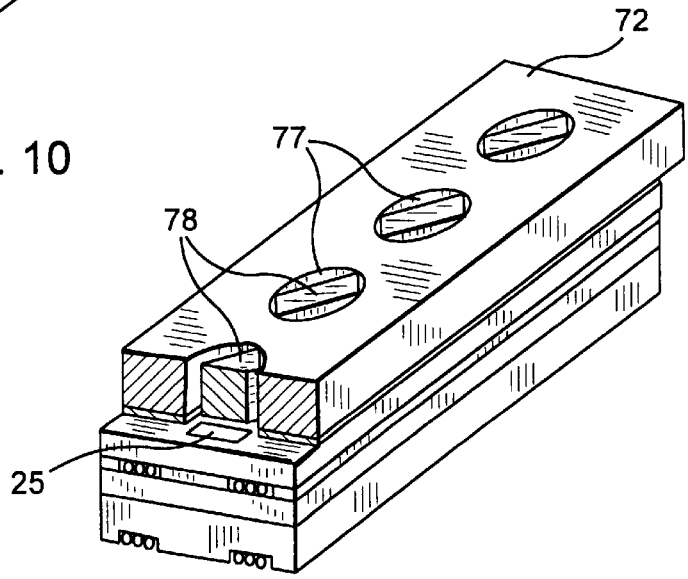
FIG. 11 is a partial, perspective view of a further embodiment of the horn arrangement.

A further modification of the horn arrangement is shown in FIGS. 9, 10, and 11. The horn structure 70 is in the form of a plate 72 having a plurality of inner cavities 74 separated by the interior walls 76. The plate 72 is positioned on top of the top ferrite layer 11 of the waveguide, so that the dipoles 25 are situated between the walls 76 facing the interior cavities 74. At the ends of the waveguide the outer interior walls are adjacent to the input flanges 30, 40 of the first and second input regions. Thus, the radiation from the windows is substantially shielded. In the embodiment of FIG. 10, the cavities 74 are formed by the interior walls 75 which are substantially parallel to each other. Thus, a plurality of inner cavities having substantially rectangular configuration is formed. In the embodiment of FIG. 11, the interior cavities 77, surrounding the respective dipoles, are substantially circular. A dielectric member 78 is disposed within each substantially circular cavity 77 at an angle of 45° with respect to the direction of dipoles. These dielectric elements enable the invention to turn the plane of polarization by 90° or to obtain a substantially circular polarization of the field. The interior walls diminish interaction between the dipoles causing the decrease of the gain modulation during the scanning of the antenna.

The antenna of the invention operates in the following manner. The matching transformer 32 enables the invention to excite the lowest or operating mode at the first input region of the three-layer waveguide. The field of this mode is concentrated within the dielectric strip 16 and in the adjacent top 11 and bottom 15 ferrite layers. Propagating along the waveguide 17 this mode excites currents in the dipoles 25 which radiate into a space. Phase shift between currents in neighboring dipoles depends on the moderation factor of the operating mode q=c/v, where v—phase velocity of the mode, c—light velocity in vacuum. Respectively, the angle position of the beam in the plane containing the waveguide axis (H-plane) is determined by the relationship $$\sin\theta = q - n\lambda/d,$$

where n is an integer, d—the distance between dipoles, angle θ is counted from normal to the antenna.

In turn, the coefficient q depends on the magnetization of the ferrite layers. Varying of q provides the beam scanning in H-plane. By means of the wires 18 of the control winding, the top and bottom ferrite layers 11, 15 are magnetized in the plane substantially perpendicular to the waveguide axis. The direction of magnetizing is shown by the arrows M in FIG. 2. The outer ferrite strips 19 and 21 of the intermediate layer 19 along with the top 11 and bottom 15 ferrite layers form a closed (toroidal) circuit of magnetic material. In this arrangement, the outer ferrite strips 19 and 21 provide closure of the magnetic flux. This structure diminishes the power consumption and the time for beam control.

Minimal time of magnetization change-over from the state of negative saturation to the state of positive saturation is 5 μs (microseconds) with energy consumption of about 1 mJ. The moderation factor changes from $q_0-\Delta q$ to $q_0+\Delta q$, where $q_0$ is an average value corresponding to the demagnetized state. This value depends on cross dimensions of the waveguide, and is within the range of 3.5–4.0; Δq is a controlled part of the moderation and is equal to 0.3–0.35. In accordance with the above formula the scanning sector is ±20°.

The above discussed data relates to the 8 mm wavelength band antenna. For 4 mm wavelength band antenna, Δq is decreased in the ratio 2:1. Accordingly the scanning sector is ±10° and the control energy consumption is less than 0.2 mJ.

The static beam position is maintained by a constant current flowing through the control winding 18 with the average consumed power of about 1–2 W. If the scanning sector is 20–25 percent narrower than above-discussed sector, utilization of the regime of magnetic latching becomes possible. This occurs when the static beam position is maintained by means of residual magnetization only, with no power being consumed. Such a regime is advantageous if the frequency of beam switching is less than 1 kHz.

It is known that ferrite is a non-reciprocal medium. As a result, the moderation factor of the operating mode propagating in the forward direction (from the antenna input) $q_+$ differs from the moderation factor $q_-$ of the same mode propagating in the opposite direction. If magnetization causes an increase of $q_+$, then $q_-$ diminishes almost in the same proportion. Thus, it is always valid that $q_++q_-\approx 2q_0$. Therefore, the beam position in the receiving regime differs from the position in the transmitting regime in accordance with the formula presented hereinabove. To keep the same beam position while switching from the transmitting to the receiving regime, it is necessary to change the direction of magnetizing from one to the opposite direction simultaneously in all ferrite elements.

The possibility of avoiding in-phase summing of reflections from the dipoles is a positive result of non-reciprocity. This phenomenon called <<normality effect>> is common to all reciprocal traveling wave antennas. If the beam is located near the normal to the antenna, then the amplitude of the reverse direction wave rises dramatically. This causes gain drop and pattern diagram distortion. In the antenna of the invention it is merely necessary to choose the distance d between the dipoles in such a way that when the beam deviates from the antenna normal at an angle equal to the beam width, in the demagnetized state ($q_+=q_-=q_0$), the in-phase summing of reflections is absent. In the invention, the in-phase summing of reflection is also absent at any magnetizing. This is because $q_++q_-\approx$constant, in the entire scanning sector including the normal beam position.

There are two methods of determining the distance d between the dipoles. As to the first method, the distance d is chosen to maintain the scanning sector to be substantially symmetrical with respect to the antenna's normal. According to the second method, almost the entire sector is disposed at one side of the antenna's normal. When the second input region 40 of the antenna (see FIG. 5) is used, identical scanning sector can be obtained at the other side from the (axis) normal. Thus, by using alternatively first and second input regions, it is possible to practically double the scanning sector.

The beam width area in the H-plane depends on the quantity of dipoles and, consequently, depends on the length of the antenna. The optimal number of dipoles varies between 15 and 60, whereas the corresponding width area of the beam is between 8° and 2°.

The antenna of the invention does not scan in the E-plane. The shape and width area of the beam in this plane are determined by the design of the horn arrangement 26 which consists of two substantially symmetrical horn elements 42 and 44.

The antenna of the invention is not a simple combination of a conventional horn antenna and an antenna with ferrite control similar to that disclosed by Russian Patent No. 2,000,633. The horn arrangement 26 of the invention is excited by the array of dipoles 25 associated with the ferrite-dielectric waveguide 17 and not by the waveguide itself as usual. The existence of the horn arrangement essentially changes the properties of the array of dipoles 25 on the ferrite-dielectric waveguide. The system of dipoles does not radiate spherical space waves, but radiates a discrete spectrum of individual cylindrical waves propagating between the inner walls of the horn arrangement 26. This substantially affects the energetic and impedance characteristics of the waves. Furthermore, the spectrum of the modes of the waves propagating in the three-layer ferrite-dielectric waveguide 17 has changed. In addition to the slow modes, there are also exist accelerated modes. Therefore, selection of the optimal dimensions of the cross-section of the waveguide and the cross-section of the antenna itself is based on the relationships which is different from that of the prior art.

As discussed hereinabove, the field of the lower operating mode of the three-layer waveguide 17 is concentrated within the intermediate dielectric strip 16 and in the adjacent top ferrite layer 11 and the bottom ferrite layer 15. The high order modes, parasitic by nature, are formed having a different field structure. The most harmful are the modes having the field which is distributed near the intermediate strip 16 and within the layers 11, 15 in the vicinity of the control wires 18 and in the outer ferrite strips or shorts 20 and 21. These modes result in additional power losses.

It has been established experimentally that the dielectric spaces 54 and 56 situated within the gaps between the spacing parts 41 and 43 of the horn elements and the top ferrite layer 11 enables the invention to suppress undesirable modes without affecting the operating mode of the antenna. Furthermore, the longitudinal grooves 58, 59 (see FIGS. 7 and 8) of a definite depth, extending from the spacing parts 41, 43 of the horn elements and facing the upper surface of the top ferrite layer 11, also, facilitate suppression of the undesirable modes. Still further, such grooves 58, 59 do not affect the operating modes. Thus, the combination of the gaps receiving dielectric spacers 41, 51 and the longitudinal grooves 58, 59 enable the invention to reduce losses and side lobe levels.

The multimode regime of the horn arrangement affect the amplitude-phase distribution of the field by varying the dimensions of the horn arrangement. This improves the pattern diagram in the E-plane and decrease the side lobe levels.

The formation of the horn arrangement also enables the invention to achieve the uniform amplitude distribution. The substantially parallel lower inner wall portions 47 and 49 of the horn elements are spaced from each other at a distance of about a half of a wavelength ($\lambda/2$.) The height of this part of the horn arrangement is also about a half of a wavelength ($\lambda/2$.) In this area of the antenna only the lowest mode can propagate, the other modes are eliminated. As a result, the upper part of the horn arrangement is excited by one mode only.

It is to be understood that the terms upward, downward, upper, lower, forward, rearward, inner, outer, and their respective derivatives as used throughout the specification refer to relative, rather than absolute orientations or positions.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A scanning antenna with ferrite control comprising:

a waveguide consisting of top and bottom ferrite layers and an intermediate layer interposed therebetween; side surfaces of the waveguide formed by said top, bottom and intermediate layers, an array of radiating dipoles situated at an upper surface of said top ferrite layer and extending along a longitudinal axis of the waveguide;

said waveguide being mounted on a solid base and said base being supported by a frame;

said intermediate layer having a strip of dielectric material with high dielectric permittivity, a control winding including a plurality of control wires, said control wires being situated at both sides of said intermediate strip of dielectric material and extending along the longitudinal axis of the waveguide to be positioned between said top and bottom ferrite layers and coiled about the bottom ferrite layer, said control windings magnetizing said top and bottom ferrite layers in a plane substantially perpendicular to the longitudinal axis of the waveguide and providing phase velocity variation of a waveguide mode, so that a front of a space wave radiated by said array of dipoles is inclined to a plane extending along said longitudinal axis of the waveguide;

a horn structure, said horn structure containing first and second horn elements extending longitudinally along both sides of said array of radiating dipoles; each said horn element having an engaging part, a spacing part and an inner wall, said engaging parts of said first and second horn elements are connected to said side surfaces of the waveguide, said spacing parts extending along and spaced from said top ferrite layer forming respective gaps therebetween;

dielectric spacers provided at both sides of the array of dipoles, each said dielectric spacer being positioned within the respective gaps matching the waveguide with the horn structure;

wherein each said inner wall consists of an upper and lower innerwall portion, said lower innerwall portions are substantially parallel to the plane normal to the top layer and passing through the longitudinal axis of the waveguide, said upper innerwall portions diverge with respect to said plane normal to the top layer so as to narrow the area of a beam to a range between 15°–45° with respect to said normal plane.

2. The antenna of claim 1, wherein said waveguide extends between first and second ends thereof, a first flange is connected to said frame at said first end of the waveguide, said first flange formed with a window adapted for connection of the waveguide with a standard waveguide, a dielectric matching transformer situated within said window and connected to the first end of the waveguide for exciting a required mode therein and forming a first input region.

3. The antenna of claim 1, wherein each said first and second horn element is formed with at least one longitudinal groove, each said longitudinal groove extends inwardly from the respective spacing part so as to face said top ferrite layer, configuration of said longitudinal grooves and thickness of said dielectric spacers are chosen to restrict excitement of the parasitic modes in the waveguide and to reduce power losses.

4. The antenna of claim 1, wherein said frame is made from a metal, said engaging and spacing parts of each said horn element are positioned at an angle to each other, whereby only one space mode is excited at the upper diverging innerwall portions of the horn structure.

5. The antenna of claim 1, wherein said intermediate layer of the waveguide further comprises intermediate ferrite strips situated between said top and bottom ferrite layers symmetrically to each other and outwardly from the control wires and extending along the longitudinal axis of the waveguide, said intermediate ferrite strips are adapted to close a control magnetic flux and to diminish a control current.

6. The antenna of claim 2, wherein said window of said first input flange is substantially covered by an inclined screen of an absorbing material having an outer metallized surface, said inclined screen adapted to prevent parasitic radiation from said window and to diminish a level of side lobes.

7. The antenna of claim 6, further comprising a second flange positioned at the second end of the waveguide, said second flange having a matching dielectric transformer connected to the second end of the waveguide and forming a second input region, whereby by switching a signal between the first and second input regions the antenna is capable of increasing a scanning sector.

8. The antenna of claim 7, wherein said second flange is covered by an inclined screen of absorbing material having an outer metallized surface.

9. The scanning antenna of claim 1, wherein a lower surface of said bottom ferrite layer is covered by a shield of metallization, so that the bottom ferrite layer, the side surfaces of the waveguide and a substantial portion of the top ferrite layer are enveloped by a shield of metallization.

10. The antenna of claim 5, wherein said intermediate ferrite strips have thickness substantially equal to the thickness of the intermediate dielectric strip, whereby width of the intermediate dielectric strip is about a half of a wavelength and combined thickness of the top, intermediate and bottom layers is substantially less than the wavelength.

11. The antenna of claim 1, wherein said substantially parallel lower inner wall portions of the first and second horn elements are spaced from each other at a distance 6f about a half of a wavelength.

12. The antenna of claim 1, wherein distance between said two adjacent radiating dipoles is about half of a wavelength.

13. A scanning antenna with ferrite control comprising:

a waveguide consisting of top and bottom ferrite layers and an intermediate layer interposed therebetween, an array of radiating dipoles situated at an upper surface of said top ferrite layer and extending along a longitudinal axis of the waveguide;

said waveguide being mounted on a solid base and said base being supported by a frame;

said intermediate layer having a strip of dielectric material with high dielectric permittivity, a control winding including a plurality of control wires, said control wires being situated at both sides of said intermediate strip of dielectric material and extending along the longitudinal axis of the waveguide to be positioned between said top and bottom ferrite layers and coiled about the bottom ferrite layer, said control windings magnetizing said top and bottom ferrite layers and providing phase velocity variation of a waveguide mode, so that a front of a space wave radiated by said array of dipoles is inclined to a plane extending along said longitudinal axis of the waveguide;

a horn structure, said horn structure containing a plurality of openings separated by metallic partitions, said horn structure being positioned on top of a dielectric layer situated at an upper surface of the top ferrite layer with said partitions situated between said dipoles.

14. The antenna of claim 13, wherein each said opening has a substantially rectangular configuration and said plurality of openings and metal partitions form a system of substantially rectangular waveguides, each said substantially rectangular waveguide is excited by the respective dipoles and radiates into a space.

15. The antenna of claim 13, wherein each said opening has a substantially rectangular configuration and said plurality of openings and metal partitions form a system of substantially circular waveguides said openings are being disposed in such a manner that said metal partitions are positioned between said dipoles.

16. The antenna of claim 15, wherein each said substantially circular opening include a dielectric plate disposed at an angle of 45° to a longitudinal axis of the respective dipoles so as to turn the plane of radiating field to an angle of 90° and forming a circularly polarized field.

17. A scanning antenna with ferrite control comprising:

a waveguide consisting of top and bottom ferrite layers and an intermediate layer interposed therebetween; side surfaces of the waveguide formed by said top, bottom and intermediate layers, an array of radiating dipoles situated at an upper surface of said top ferrite layer and extending along a longitudinal axis of the waveguide;

said waveguide being mounted on a solid base and said base being supported by a frame;

said intermediate layer having a strip of dielectric material with high dielectric permittivity, a control winding including a plurality of control wires, said control wires being situated at both sides of said intermediate strip of dielectric material and extending along the longitudinal axis of the waveguide to be positioned between said top and bottom ferrite layers and coiled about the bottom ferrite layer;

a horn structure, said horn structure containing first and second horn elements extending longitudinally along both sides of said array of radiating dipoles, each said horn element having an engaging part, a spacing part and an inner wall, said engaging parts of said first and second horn elements are connected to said side surfaces of the waveguide, said spacing parts extending along and spaced from said top ferrite layer forming respective gaps therebetween;

dielectric spacers provided at both sides of the array of dipoles, each said dielectric spacer being positioned within the respective gaps, each said first and second horn element is formed with at least one groove extending longitudinally along the axis of the waveguide, each said longitudinal groove extends inwardly from the respective spacing part and transversely to said top ferrite layer, said longitudinal grooves and said dielectric spacers restrict excitement of the parasitic modes in the waveguide and reduce power losses.

18. The antenna of claim 17, wherein each said inner wall consists of an upper and lower innerwall portion, said lower innerwall portions are substantially parallel to the plane normal to the top layer, said upper innerwall portions diverge with respect to said plane normal to the top ferrite layer so as to narrow the area of a beam to a range between 15°–45° with respect to said normal plane.

19. The antenna of claim 17, wherein each said first and second horn element is formed with a pair of grooves extending longitudinally along the axis of the waveguide inwardly from the respective spacing part and transversely to said top ferrite layer.

20. The antenna of claim 17, wherein inner wall portions of said first and second horn elements diverge with respect to said plane normal to the top ferrite layer.

* * * * *